US007001503B1

(12) United States Patent
Koyama et al.

(10) Patent No.: US 7,001,503 B1
(45) Date of Patent: Feb. 21, 2006

(54) METHOD AND APPARATUS FOR STRIPPING SULFUR-CONTAINING COMPOUNDS FROM HYDROCARBON FEED STOCK IN HYDROREFINING OF PETROLEUM DISTILLATES

(75) Inventors: Hiroki Koyama, Toda (JP); Yuichi Takahashi, Toda (JP)

(73) Assignee: Japan Energy Corporation, Tokyo (JP)

( * ) Notice: Subject to any disclaimer, the term of this patent is extended or adjusted under 35 U.S.C. 154(b) by 0 days.

(21) Appl. No.: 09/889,241

(22) PCT Filed: Jan. 14, 2000

(86) PCT No.: PCT/JP00/00147

§ 371 (c)(1),
(2), (4) Date: Jul. 13, 2001

(87) PCT Pub. No.: WO00/42130

PCT Pub. Date: Jul. 20, 2000

(30) Foreign Application Priority Data

Jan. 14, 1999 (JP) ..... 11-007381

(51) Int. Cl.
*C10G 45/02* (2006.01)
*C10G 65/02* (2006.01)
*B01J 8/04* (2006.01)

(52) U.S. Cl. ..... 208/210; 208/213; 208/57; 208/58; 208/59; 422/149; 422/191; 422/193; 422/194; 422/195

(58) Field of Classification Search ..... 208/210, 208/213, 57, 58, 59; 422/149, 191, 193, 422/194, 195
See application file for complete search history.

(56) References Cited

U.S. PATENT DOCUMENTS 3,091,586 A * 5/1963 Pappas et al. ..... 208/210
3,159,564 A * 12/1964 Kelley et al. ..... 208/59
3,652,450 A * 3/1972 Boyd ..... 208/146
3,723,300 A * 3/1973 Carson et al. ..... 208/146
4,430,203 A * 2/1984 Cash ..... 208/210
4,695,364 A * 9/1987 Graziani et al. ..... 208/59
6,036,844 A * 3/2000 Gupta et al. ..... 208/49

* cited by examiner

*Primary Examiner*—Walter D. Griffin
(74) *Attorney, Agent, or Firm*—Birch, Stewart, Kolasch & Birch, LLP

(57) ABSTRACT

A unit for hydrorefining of hydrocarbon crude oil comprising sulfur-containing compounds comprises first catalyst layer 33 and second catalyst layer 38, top space 34 for separating vapor component and liquid component, bottom space 36, and valve tray 35 that divides top space 34 and bottom space 36. Hydrogen released from hydrogen nozzle 40 placed in the bottom space is passed through liquid component that has accumulated in the valve tray and stripping of liquid components is performed. Hydrogen released from hydrogen nozzle 40 is again introduced, to second catalyst layer 38 as a cocurrent with the stripped liquid component. By stripping, it is possible to reduce the sulfur content, the nitrogen content and reduce the aromatic content of the hydrocarbon crude oil when compared to the conventional method. Since the hydrorefining unit has a simple structure, the unit can be easily made by modifying existing units.

17 Claims, 4 Drawing Sheets

METHOD AND APPARATUS FOR STRIPPING SULFUR-CONTAINING COMPOUNDS FROM HYDROCARBON FEED STOCK IN HYDROREFINING OF PETROLEUM DISTILLATES

This application is the national phase under 35 U.S.C. § 371 of PCT International Application No. PCT/JP00/00147 which has an International filing date of Jan. 14, 2000, which designated the United States of America and was not published in English.

TECHNICAL FIELD

The present invention relates to hydrorefining of petroleum middle distillate, such as kerosene, gas oil, and particularly, to a hydrorefining apparatus and hydrorefining method for obtaining super-low-sulfur middle distillates with a sulfur content of 150 ppm or less.

BACKGROUND ART

A method for hydrorefining crude oil by mixing the crude oil with hydrogen, heating and bringing into contact with hydrorefining catalysts loaded in multiple catalyst layers is known as a typical hydrorefining method for obtaining low-sulfur gas oil with a sulfur content of 500 ppm or less. In this method, there are also cases wherein hydrogen is further introduced between the multiple catalyst layers. However, the concentration of impurities, such as hydrogen sulfide, ammonia, etc., produced by hydrorefining contained in the hydrorefined hydrocarbons near the outlet of the catalyst layers rises and therefore, hydrorefining wherein contents of the sulfur and nitrogen are adequately reduced is difficult. The hydrogen sulfide, ammonia, etc., inhibit catalytic reaction and as a result, activity of the catalyst is markedly reduced. Consequently, as disclosed in U.S. Pat. Nos. 5,705,052 and 5,720,872, hydrogen sulfide and ammonia gas that have been dissolved in the hydrorefined hydrocarbons are stripped inside a vessel separate from the reaction column in which the catalyst layers have been set up.

With this type of hydrorefining unit, hydrogen and feed oil are brought into contact with catalyst as a cocurrent. The method is known whereby the hydrogen sulfide and ammonia impurities dissolved in the effluent are removed by allowing hydrogen to flow into the catalyst as a countercurrent to the liquid hydrocarbons (feed oil) that flow through the catalyst, as described in, for instance, Japanese Patent No. 2,617,158.

However, it is difficult to hydrorefine gas oil distillates in order to bring the sulfur content to 150 ppm or less, particularly 50 ppm or less, with the above-mentioned conventional unit and method. In particular, there is a problem that the allowable range of the gas quantity of flow and feed oil quantity of flow with which stable operation is possible is narrow in hydrorefining units with which the previously mentioned hydrogen and feed oil are brought into contact with catalyst as cocurrent and therefore, operation is not simple.

SUMMARY OF THE INVENTION

The first object of the present invention is to provide a hydrorefining method which can make sulfur content, nitrogen content, and aromatic content lower than with conventional hydrorefining methods.

The second object of the present invention is to provide a hydrorefining unit with a simple structure, and that can be made by simple modification of existing hydrorefining units.

In accordance with the first aspect of the present invention, a hydrorefining unit for hydrorefining hydrocarbon feed oil containing surfur-containing compounds is provided, which comprises a first catalyst layer and a second catalyst layer; a holding member positioned between the first catalyst layer and the second catalyst layer for temporarily holding the liquid component that flows out from the first catalyst layer; a hydrogen feed source; and a hydrogen introduction part connected with the hydrogen feed source for simultaneously introducing hydrogen from the hydrogen feed source to the liquid component that has been held in the holding member and the second catalyst layer.

With the hydrorefining unit of the present invention, liquid component flowed out from the first catalyst layer is held by a holding member provided between the first catalyst layer and the second catalyst layer and the hydrogen sulfide and ammonia in the liquid component can be stripped by introducing hydrogen from the hydrogen introduction part to this liquid component held in the holding member. As a result of this stripping, hydrorefining in the second catalyst layer can be started in an ambient atmosphere that does not comprise impurities such as hydrogen sulfide, ammonia, etc., and a hydrorefined product with a super-low sulfur content, super-low nitrogen content, and low aromatic content can be obtained. Hydrogen from the hydrogen introduction part also can be fed to the second catalyst layer. Therefore, with the unit of the present invention, it is possible to simultaneously feed hydrogen for stripping and hydrogen for hydrorefining at the second catalyst layer from the hydrogen feed source. Consequently, impurities such as hydrogen sulfide, ammonia, etc., can be easily removed using a simple unit structure.

It is preferred that the hydrogen introduction part of the unit of the present invention be arranged on the downstream side of the holding member and on the upstream side of the second catalyst layer. By arranging the hydrogen introduction part in this way, some of the hydrogen that has been introduced can rise to the holding member, while the remainder of the hydrogen can move toward the second catalyst layer together with liquid component that has flown out from the holding member.

It is preferred that the first catalyst layer, second catalyst layer, and holding member of the unit of the present invention be housed in a single reaction vessel. When constructed in this way, the unit of the present invention can be made easily by modifying ordinary hydrorefining units with a first catalyst layer and a second catalyst layer. In this case, the hydrogen introduction part can be provided between the holding member and the second catalyst layer.

The above-mentioned holding member may be a tray having a discharge hole for liquid component and in which the liquid component accumulates. It can be, for instance, a valve tray, a sieve tray, or a cap tray. The above-mentioned holding member may also be a packing material through which the liquid component can pass.

In accordance with the second aspect of the present invention, a method for hydrorefining hydrocarbon feed oil comprising a sulfur-containing compound using at least two catalyst layers is provided, which comprises the steps of introducing hydrocarbon feed oil to the first catalyst layer together with hydrogen; stripping the liquid component that has flown out from the first catalyst layer with the first hydrogen gas stream that is fed from the hydrogen introduction part; and introducing the stripped liquid component to the second catalyst layer together with the second hydrogen gas stream that is fed from the hydrogen introduction part.

By means of the present invention, hydrogen for stripping and hydrogen for hydrorefining can be shared and therefore, it is possible to make a hydrorefining plant with a simple structure and at low cost.

The above-mentioned hydrogen introduction part can be provided between a first catalyst layer and a second catalyst layer in the method of the present invention. Moreover, it is preferred that the liquid component flowing out from the first catalyst layer be temporarily held in the holding member. In this case, the first hydrogen gas stream and the second hydrogen gas stream can be introduced between the above-mentioned holding member and the second catalyst layer.

The second hydrogen gas stream can be introduced to the second catalyst layer together with the stripped liquid component and as a cocurrent to the above-mentioned liquid component. It is preferred in the present invention that the hydrocarbon feed oil be hydrocarbon oil with a 90% distillation temperature of 250° C. or higher.

The method of the present invention can further comprise removing the vapor component produced from the first catalyst layer and the vapor component produced by stripping. Vapor component comprising impurities, such as hydrogen sulfide, ammonia, etc., is removed from the product of the first catalyst layer and the liquid component is again stripped with fresh hydrogen. Therefore, hydrorefining in the second catalyst layer can be performed in an ambient atmosphere that does not comprise impurities such as hydrogen sulfide, ammonia, etc., to obtain a hydrorefined product with a super-low sulfur content, super-low nitrogen content, and low aromatic content.

BEST MODE FOR CARRYING OUT THE INVENTION

[Feed Oil]

Figure 1:
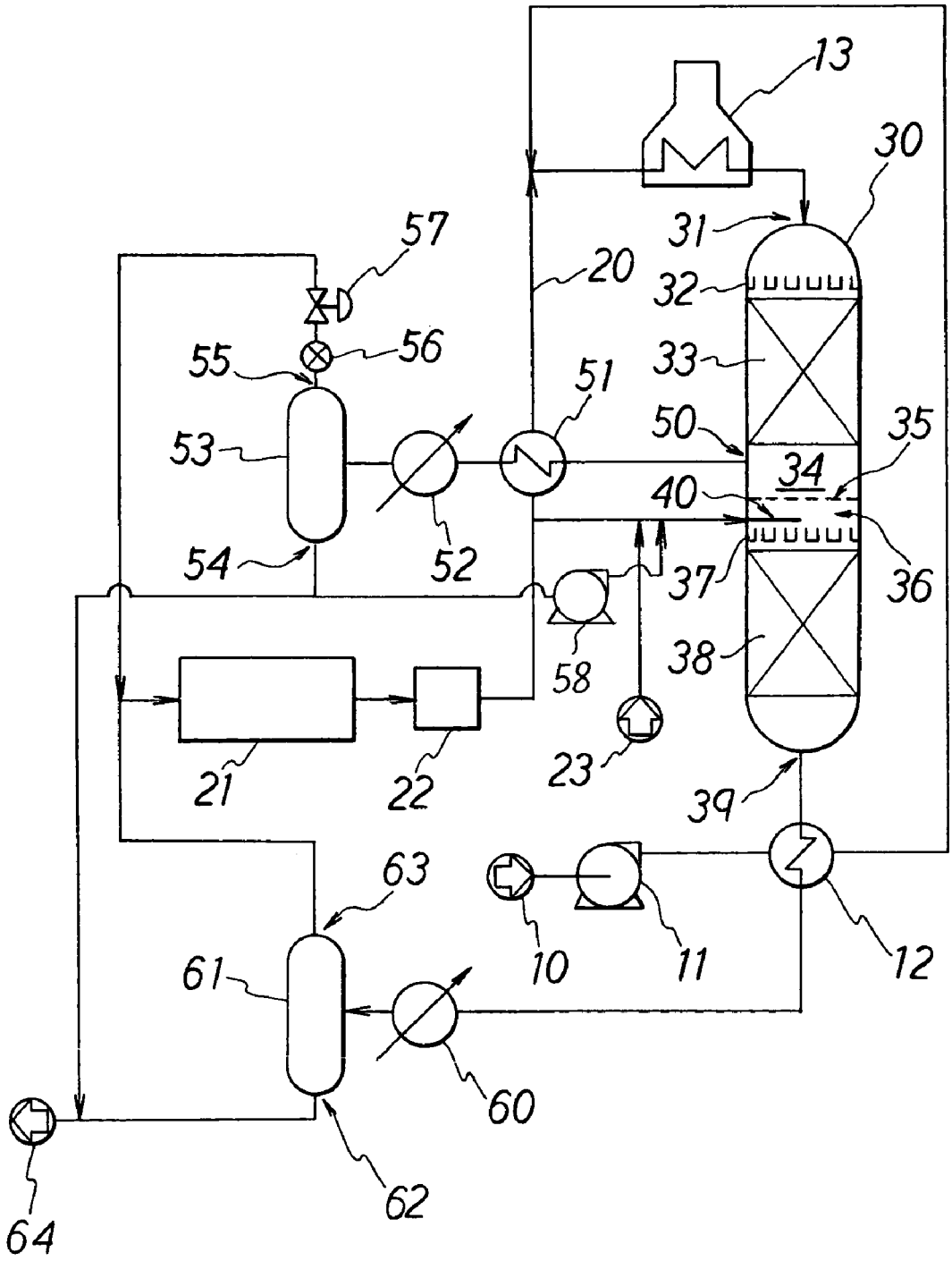
FIG. 1 is an explanatory view that explains the hydrorefining unit according to an embodiment of the present invention.

The hydrocarbon feed oil, as used in the present invention, is feed oil that has been obtained via hydrorefining processes, such as distillation from petroleum and coal liquefaction oil, etc., which may be petroleum substitute. For example, it is preferred that middle distillate products and gas oil bases for diesel fuel with a 90% distillation temperature of 250° C. or higher, particularly 300 to 400° C., be used. The typical properties of gas oil for diesel fuel are a 10% distillation temperature of 220 to 300° C., a 50% distillation temperature of 260 to 340° C., and a 90% distillation temperature of 320 to 380° C. Direct light oil distillate obtained by atmospheric distillation of crude oil, thermal cracking oil which is the light distillate obtained by a reaction which is mainly a radical reaction wherein heat is applied to heavy distillate, catalytic cracking oil which is obtained when middle distillates and heavy distillates are catalytically cracked by a zeolite catalyst can be used. Furthermore, the distillation temperature is the value from JISK 2254 "Fuel Oil Distillation Testing Methods."

[Filler Hole for Feed Oil and Hydrogen]

A filler hole for feed oil and hydrogen is provided at the upstream part of the hydrorefining vessel used in the present invention. Separate filler holes for feed oil and hydrogen can also be provided, but a mixture of the feed oil and hydrogen is usually heated and introduced to the reaction vessel.

[Catalyst Layer]

At least two fixed bed catalyst layers are used in the present invention. These may be kept in multiple reaction vessels, but it is preferred that they be kept in a single reaction vessel.

The catalyst used in the first catalyst layer and second catalyst layer preferably comprises approximately 5 to 30 wt % in terms of metal element of at least one type of Periodic Table Group 6 metal element, particularly molybdenum or tungsten, and a total amount of 1 to 10 wt % in terms of metal element of at least one type of Group 8 non-noble metal element, particularly either nickel or cobalt or both, supported on an alumina carrier. It is preferred that a catalyst be used wherein in addition to these metals, 0.1 to 8 wt % phosphorus in terms of phosphorus element is supported. In addition to alumina, the carrier may also comprise compound oxides with high acidity, such as silica alumina, titania alumina, zeolite, etc., and a Group 8 noble metal element may also be supported as the metal component.

[Holding Member]

The unit of the present invention has a holding member positioned between the first catalyst layer and the second catalyst layer for temporarily holding the liquid component that has flown out from the first catalyst layer. The holding member can be, for instance, a tray, such as a valve tray, a sieve tray, a cap tray, etc., set up in the space between the two catalyst layers. The liquid phase hydrocarbon oil can stay in this tray and the vapor component present in the top space of the tray is kept from passing to the bottom space of the tray by this hydrocarbon oil that stays in the tray, while the vapor component in the bottom space of the tray can pass to the top space of the tray. A packing bed that has been packed with a packing material, such as Raschig rings, etc., can be provided in place of the above-mentioned tray for accumulation of the liquid. Furthermore, the holding member also functions as a separation means that separates the vapor component and the liquid component that have passed through the first catalyst layer.

Impurities, such as hydrogen sulfide and ammonia, etc., can be removed from the liquid component by feeding hydrogen gas to the liquid component that has accumulated in the above-mentioned holding member and stripping the liquid component of impurities. It is preferred that a means for adjusting the pressure of the top space and/or the bottom space of the holding member be added in order to adjust the quantity of flow of hydrogen gas for stripping. Controlling extraction of vapor component from the top space, or controlling the amount of hydrogen introduced to the bottom space, so that the quantity of flow of stripping gas is constant can be used as such an adjusting means.

[Stripping]

The hydrocarbon oil that is held or stays on the holding member is stripped by hydrogen. Stripping is preferably performed by introducing hydrogen in the form of bubbles from the base of the hydrocarbon oil layer. The hydrogen that is introduced preferably has a low hydrogen sulfide concentration of usually 500 volume ppm or less, particularly 100 volume ppm or less.

[Top Space]

There is a top space (also referred to as separation space) between the holding member and the first catalyst layer. Of the hydrocarbons, hydrogen, hydrogen sulfide, ammonia, etc., that flow out from the first catalyst layer, the liquid component stays on the holding member, while the vapor component fills the top space. Moreover, the hydrogen that has stripped the liquid component and the vapor component produced by the same stripping in the holding member also flow into the top space.

[Gas Discharge Hole]

A gas discharge hole is formed in the top space for guiding the vapor component that is fills the top space to the outside (also referred to as "gas outlet"). The gasified hydrocarbons, hydrogen, hydrogen sulfide, ammonia, etc., are removed from the discharge hole. The removed vapor component is usually cooled to liquefy the hydrocarbon oil and isolate the hydrocarbon oil from hydrogen comprising impurities such as hydrogen sulfide, ammonia, etc., and hydrocarbon gases, such as methane. The separated hydrogen is recycled after impurities such as hydrogen sulfide, ammonia, etc., are removed therefrom.

[Bottom Space]

A bottom space is provided between the holding member and the second catalyst layer. A hydrogen introduction part is set up in the bottom space and hydrogen is introduced from the hydrogen introduction part to the bottom space. This hydrogen is used for stripping at the holding member, or it is mixed with the hydrocarbon oil that flows down from the holding member into the second catalyst layer. It is preferred that a dispersion means, such as a distributor tray, be provided in between the hydrogen introduction part and the second catalyst layer in order to provide uniform flow to the second catalyst layer.

[Product Outlet]

A product outlet is provided at the bottom of the second catalyst layer. Hydrogen comprising hydrogen sulfide, etc., and hydrorefined hydrocarbon oil flow out from the second catalyst layer and these products are usually cooled and separated into hydrogen gas comprising hydrogen sulfide and hydrocarbon oil. The hydrogen sulfide, etc., is removed from hydrogen comprising hydrogen sulfide that has separated and the purified hydrogen is recycled.

[Reaction Vessel]

In the present invention, the two catalyst layers, holding member, filler hole, top space, bottom space, gas discharge hole, hydrogen introduction part, product outlet, etc., may be stored in multiple vessels, but it is preferred that they be housed in one vessel. It is particularly preferred that when a modified ordinary reaction vessel is used, a single through hole be made in the reaction vessel wall and that this through hole be continuous with the gas discharge hole and the hydrogen introduction part. By providing the single through hole, it is enabled to reduce the number of parts of the reaction vessel to be modified. When an ordinary reaction vessel has a through hole for introduction of hydrogen for cooling, the gas discharge hole and hydrogen introduction part can be connected with this through hole, whereby a modification processes to form a new through holes can be omitted.

[Hydrorefining]

In the operating conditions for hydrorefining according to the present invention, a liquid space velocity of 0.1 to 10 [$hr^{-1}$], preferably 0.1 to 2.0 [$hr^{-1}$], a hydrogen/oil ratio of 100 to 2,000 [L/L], preferably 200 to 500 [L/L], and a hydrogen pressure of 20 to 200 $kg/cm^2$, preferably 40 to 100 $kg/cm^2$ are used. The reaction temperature depends on the catalyst that is used, but is usually 220 to 450° C., particularly 300 to 400° C.

When light oil base distillate is hydrorefined according to the present invention, the sulfur content becomes 150 ppm or less, preferably 50 ppm or less. It is further possible to bring the sulfur content to 150 ppm or less, total aromatic content to 25 vol % or less, particularly 20 vol % or less, and the aromatic content of 2-rings or more to 2 vol % or less, particularly 1 vol % or less. In addition, the nitrogen content can usually be brought to 1 ppm or less, and the aromatic content of 3-rings or more can be brought to 0.2 vol % or less, particularly 0.1 vol % or less.

The hydrogen used for stripping in the present invention may be gas that comprises hydrogen as the main component, and it can be a mixed gas comprising 80 to 90 molar % hydrogen, such as a mixed gas with methane.

EMBODIMENTS

Embodiments of the hydrorefining unit and the hydrorefining method of the present invention will be described in concrete terms below in reference to the drawings, but the present invention is not limited to the embodiments.

Embodiment 1

In the hydrorefining unit in FIG. 1, feed oil 10 is pressurized with pump 11, preheated by heat exchanger 12, mixed with hydrogen gas 20, and then heated by heater 13 to the temperature needed for hydrorefining. The mixed fluid consisting of the heated feed oil and hydrogen gas is fed to filler hole 31 formed at the top end of cylindrical reaction vessel 30, uniformly dispersed by first distributor tray 32, and descends to first catalyst layer 33 loaded with hydrorefining catalyst. The feed oil in the mixed fluid is partially hydrorefined in the presence of hydrogen and the same intermediate product flows out from the bottom end of first catalyst layer 33.

Valve tray 35 is provided at the bottom of first catalyst layer 33 with top space 34 interposed therebetween. Of the intermediate product that has flowed out from the bottom end of first catalyst layer 22, the vapor component accumulates in the top space, while the liquid component accumulates in valve tray 35. Structure of the valve trays will be described later.

Second distributor tray 37 is provided underneath valve tray 35 with bottom space 36 interposed therebetween. Hydrogen gas is introduced to bottom space 36 by hydrogen gas nozzle 4, which is the hydrogen gas introduction part. Some of the hydrogen gas that has been introduced rises to become bubbles in the liquid component on valve tray 35 and comes into contact as a countercurrent to the liquid component that has accumulated on the tray so that the vapor component, such as hydrogen sulfide, etc., contained in the liquid component is stripped. The gas used for stripping is mixed with vapor component from first catalyst layer 33 in top space 34. Extraction nozzle 50, which serves as the gas discharge hole, is provided in top space 34 so that the mixed vapor component is extracted to outside reaction vessel 30.

The liquid component that has been stripped flows out from valve tray 35 to bottom space 36, is mixed with hydrogen gas from hydrogen nozzle 4 and descends to second catalyst layer 38 loaded with hydrorefining catalyst through second distributor tray 37. The liquid component is further hydrorefined in the presence of hydrogen and its product flows out from the bottom end of second catalyst layer 38 and is removed from guide opening 39 provided at the bottom end of reaction vessel 30.

The removed product is cooled by feed oil in heat exchanger 12 and further cooled by heat exchanger 60. The cooled product is fed to high-pressure separation cell 61. The hydrorefined liquid component is removed from base 62 of high-pressure separation cell 61 as product oil 64. Moreover, the component extracted from extraction nozzle 50 is also liquefied to become product oil 64.

The vapor component extracted from extraction nozzle 50 is cooled by hydrogen gas 20 in heat exchanger 51 and further cooled in heat exchanger 52 and fed to high-pressure separation cell 53. Of the extracted vapor component, the hydrorefined hydrocarbon oil is liquefied by cooling and removed from base 54 of high-pressure separation cell 53 to become product oil 64. Moreover, when necessary, part of this hydrocarbon oil can be pressurized by pump 58, introduced to hydrogen nozzle 40, and fed to the second catalyst layer through second distributor tray 37 in order to improve desulfiding activity.

Of the extracted vapor component, the hydrogen component comprising hydrogen sulfide, etc., is removed from over head 55 of high-pressure separation cell 53 and sent to hydrogen recycling unit 21 via flow meter 56 and flow adjustment valve 57. Stripping in valve tray 35 can be adjusted by adjusting the quantity of flow of this hydrogen component. Flow adjustment valve 57 is controlled in accordance with the indication on flow meter 56 so that quantity of flow is brought to the quantity of flow with which adequate stripping is possible.

The hydrogen component comprising hydrogen sulfide, etc., is sent from over head 55 of high-pressure separation cell 53, or from over head 63 of high-pressure separation cell 61, to hydrogen recycling unit 21. Hydrogen from which impurities such as hydrogen sulfide, etc., have been removed by hydrogen recycling unit 21 is pressurized by compressor 22 as recycled hydrogen. Some of the pressurized recycled hydrogen is mixed with make-up hydrogen 23 obtained by the hydrogen production process (not shown) and sent from hydrogen nozzle 40 to bottom space 36. This hydrogen is used for stripping in valve tray 35 and hydrorefining at second catalyst layer 38.

The remainder of the pressurized recycled hydrogen becomes hydrogen gas 20 that has been preheated by heat exchanger 51 and is mixed with preheated oil 10 and used for hydrorefining at first catalyst layer 33.

Figure 2:
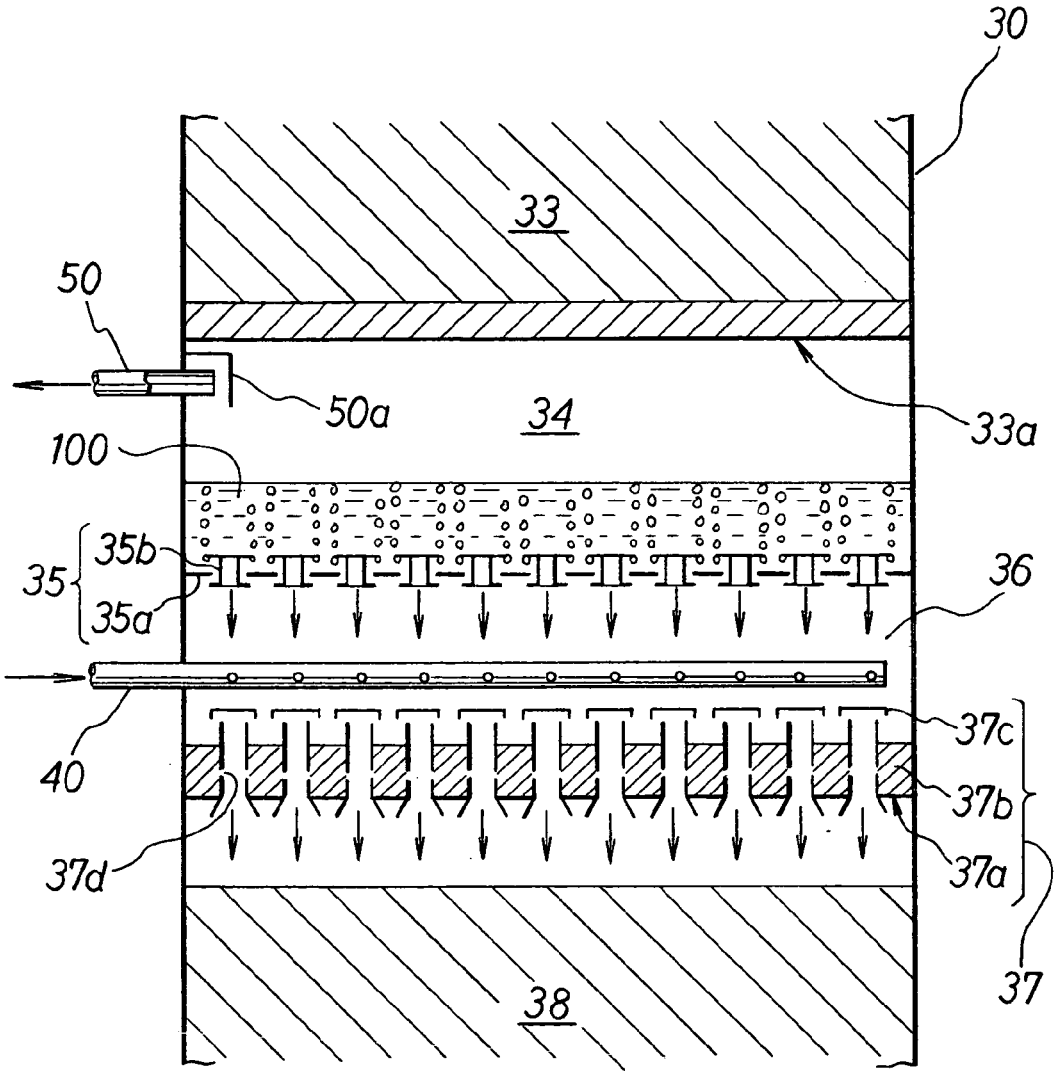
FIG. 2 is a cross sectional view that describes part of the reaction vessel of the embodiment.

The structure near valve tray 35 will be further explained using FIG. 2. Catalyst particles are held by tray 33*a* at the bottom end of first catalyst layer 33 inside reaction vessel 30 and valve tray 35 is placed underneath the same. Valve tray 35 is obtained by forming multiple holes, which serve as the discharge holes for liquid component, in diaphragm 35*a*, and a valve 35*b* is provided slidably in each of the holes. When each valve 35*b* is lifted up by the pressure of the hydrogen that has been fed from nozzle 40 into bottom space 36, gaps are formed between valves 35*b* and diaphragm 35*a*. The hydrogen gas passes from these gaps through liquid layer 100, which consists of liquid component accumulated on valve tray 35, and floats up. As a result, the liquid component is stripped by hydrogen gas with good efficiency. In the meantime, the liquid component falls through these gaps into bottom space 36.

Extraction nozzle 50, with which the hydrogen gas used in stripping and the vapor component that flows out from first catalyst layer 33 are removed from reaction vessel 30, runs through a side wall of reaction vessel 30 and opens at top space 34. Hood 50*a* is provided above the open part of extraction nozzle 50 so that liquid component of intermediate product will not directly enter the opening.

Hydrogen nozzle 40 for feeding the hydrogen used in stripping on valve tray 35 and in hydrorefining at second catalyst layer 38 runs through the side wall of reaction vessel 30 at bottom space 36 underneath valve tray 35. Hydrogen nozzle 40 is a tube having many openings in its side walls. It diffuses and injects hydrogen gas into bottom space 36 so that it comes into uniform contact with the liquid component that has passed through valve tray 35.

This liquid component accumulates on second distributor tray 37, the quantity of flow becomes uniform, and the liquid component is fed to second catalyst layer 38. Second distributor tray 37 has a structure wherein multiple chimneys 37*d* are provided on diaphragm 37*a*. Each chimney 37*b* is cylindrical and opening 37*d* is formed in its side wall. Therefore, the liquid component that has accumulated in the chimneys uniformly flows from the same openings 37*d* to second catalyst layer 38. Hood 37*c* is provided above chimney 37*b* so that he liquid component that has passed through valve tray 35 does not directly reach second catalyst layer 38.

Embodiment 2

Figure 3:
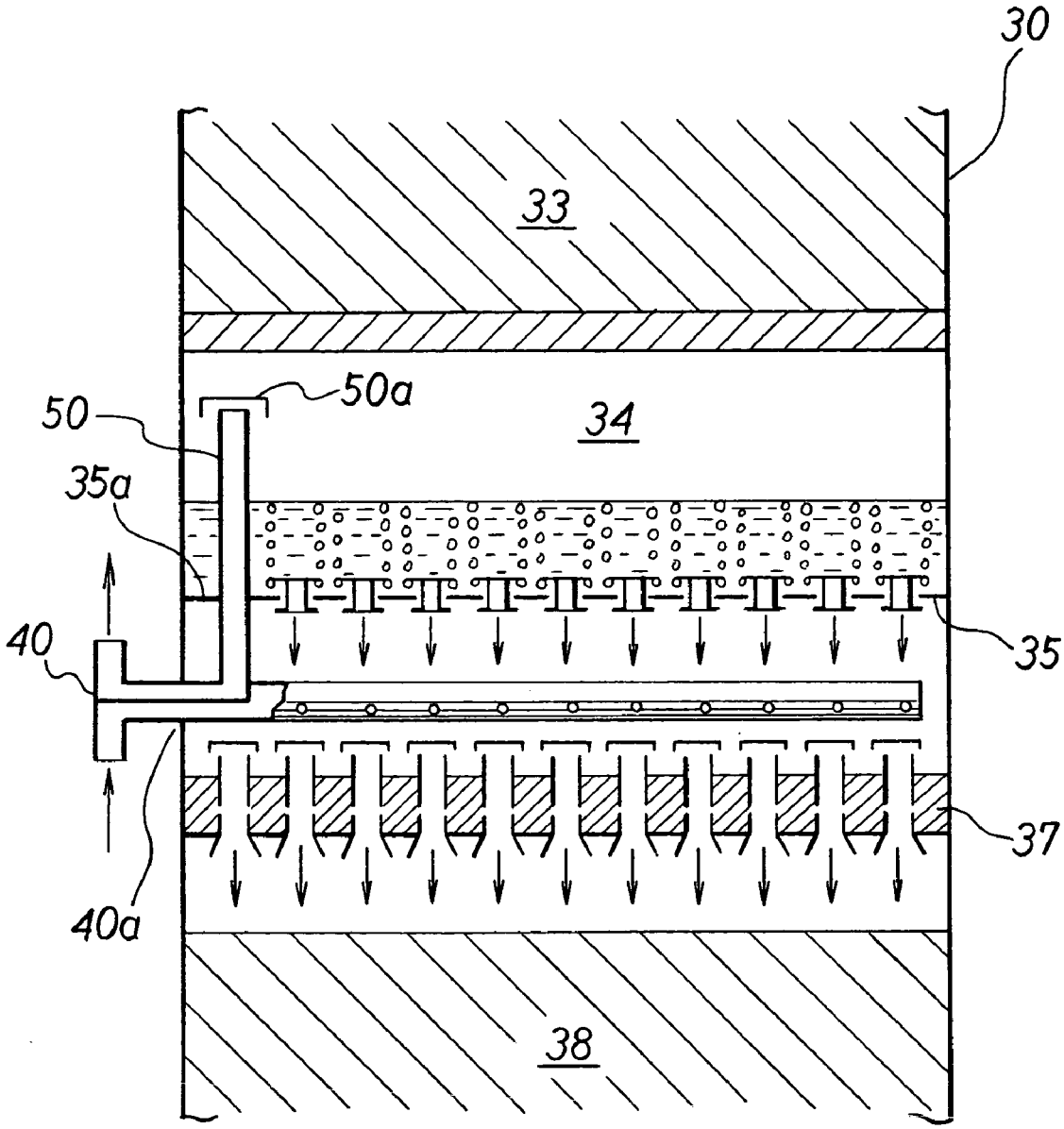
FIG. 3 is a cross sectional view that describes an embodiment of a different form of the part of the reaction vessel in FIG. 2.

Another embodiment of the hydrorefining unit of the present invention will now be described in concrete terms using FIG. 3. The structure near valve tray 35 shown in FIG. 3 is approximately the same as the structure shown in FIG. 2, but it differs in terms of the arrangement of extraction nozzle 50. Extraction nozzle 50 in FIG. 3 is introduced into reaction vessel 30 via through hole 40*a* which runs through the side wall of reaction vessel 30, and further extends to top space 34 through diaphragm 35*a* of valve tray 35. When this type of structure is employed, the number of through holes leading to reaction vessel 30 can be reduced and therefore, the unit of the present invention can be obtained easily by modifying an ordinary reaction vessel used in hydrorefining.

Embodiment 3

Figure 4:
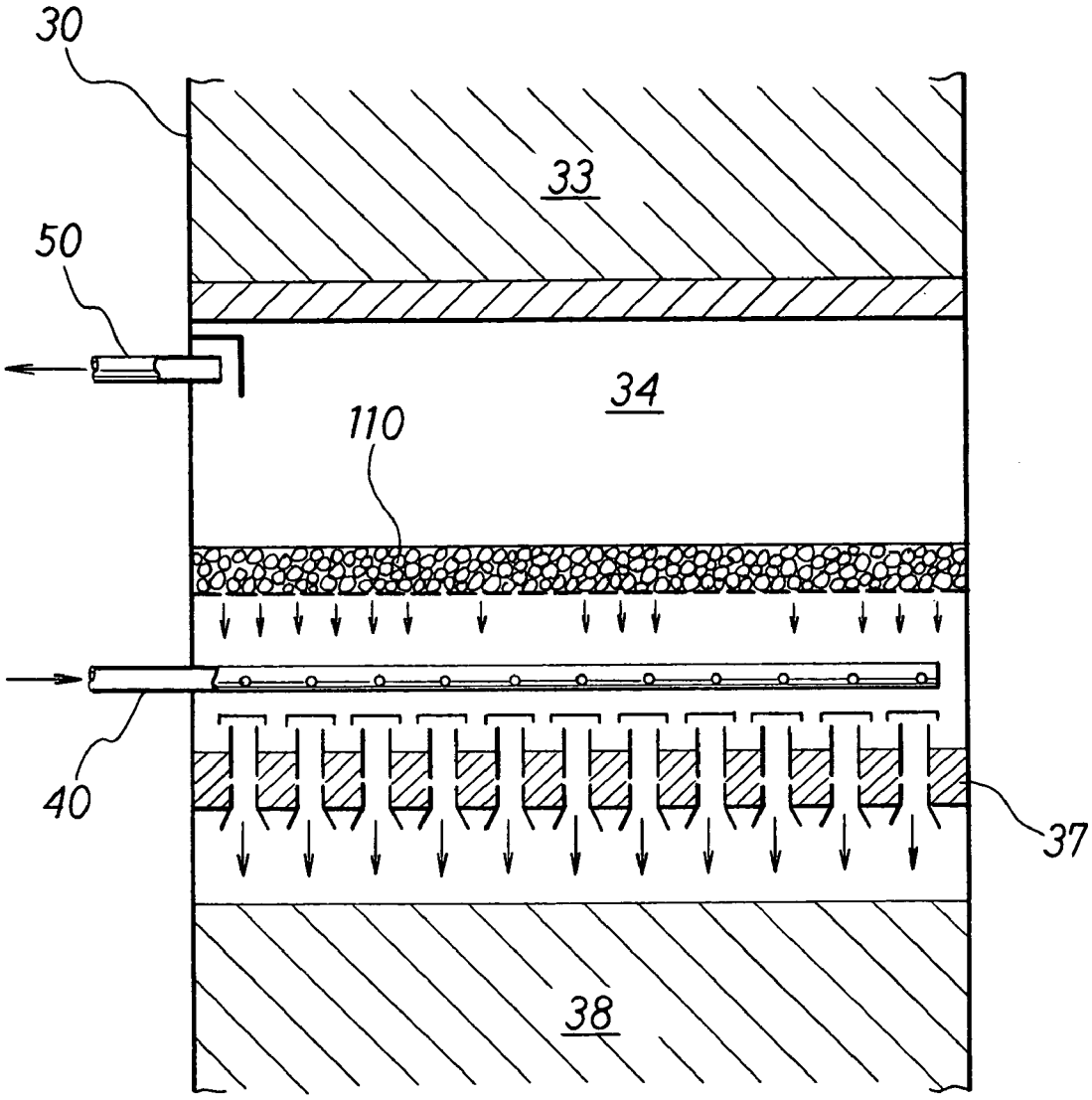
FIG. 4 is a cross sectional view that describes an embodiment of yet another different form of the part of the reaction vessel in FIG. 2.

A modified hydrorefining unit of the present invention will now be described using FIG. 4. The hydrorefining unit in FIG. 3 is the same as the unit in Embodiment 1 with the exception that the valve tray in FIGS. 1 and 2 has been changed to packing material layer 110. Raschig rings packed on top of a base with multiple openings can be used as packing layer material 110. When the liquid component that flows out from first catalyst layer 33 passes through packing layer 110, it comes into contact as a countercurrent with the hydrogen that is rising up from packing material layer 110 and stripping is thereby performed with good efficiency.

The hydrorefining unit and method of the present invention have been explained in concrete terms with embodiments, but the present invention is not limited to these embodiments and can comprise various changes and modifications conceived of by a person skilled in the art. Hydrogen nozzle 40 was placed in the space underneath valve tray 35 in Embodiments 1 and 2, but a plate with hydrogen nozzle spray holes that serve as the hydrogen introduction part can be provided at the same position in place of valve tray 35. This plate has a hydrogen feed path inside and multiple hydrogen spray holes joining with the hydrogen feed path in the top and bottom surfaces of the plate. The hydrogen spray holes made in the top surface of the plate can feed hydrogen for stripping to liquid component on the plate. The hydrogen spray holes formed in the bottom surface of the plate can feed hydrogen for hydrorefining to the second catalyst layer. Moreover, it is also possible to make multiple through holes in the plate so that they do not interfere with the hydrogen feed path in the plate and thereby to allow the liquid component to pass through these through holes and fall from on top of the plate to the bottom space underneath the plate.

As another embodiment, it is also possible to make hydrogen nozzle 40 shown in FIGS. 2 and 3 branch into a first tube and a second tube in bottom space 36 and place the first tube on diaphragm 35*a*. Part of the hydrogen introduction part can also be provided inside the holding member. In this case, valves 35*b* can be omitted. On the other hand, the second tube can be placed at the same position as hydrogen nozzle 40 in FIGS. 2 and 3.

What is claimed is:

1. A method for hydrorefining hydrocarbon feed oil including a sulfur-containing compound using at least two catalyst layers, comprising the steps of:

introducing hydrocarbon feed oil to the first catalyst layer together with hydrogen;

temporarily holding, by using a holding member, a liquid component that has flown out from the first catalyst layer, and stripping the liquid component with a first hydrogen gas stream that is fed from a hydrogen introduction part provided between the first catalyst layer and the second catalyst layer so that the first hydrogen gas stream passes through the liquid component as a countercurrent to the liquid component;

removing a vapor component that has been produced from the first catalyst layer and a vapor component that has been produced by stripping, while adjusting flow of the vapor component produced from the first catalyst layer and the vapor component produced by stripping in order to perform the stripping; and introducing the stripped liquid component to the second catalyst layer together with and cocurrent with a second hydrogen gas stream that is fed from the hydrogen introduction part.

2. A hydrorefining method according to claim 1, wherein the holding member is a tray which has a liquid discharge hole and in which liquid component accumulates.

3. A hydrorefining method according to claim 1, wherein the holding member is a packing material through which the liquid component can pass.

4. A hydrorefining method according to claim 1, wherein the hydrocarbon feed oil is hydrocarbon oil in which 90 vol % distillation temperature is 250° C. or higher.

5. A hydrorefining method according to claim 1, wherein the hydrocarbon feed oil has a 10 vol % distillation temperature of 220 to 300° C. and a 90 vol % distillation temperature of 320 to 380° C., and the hydrorefined hydrocarbon feed oil has a sulfur content of not more than 150 ppm.

6. The hydrorefining method of claim 1, comprising the further step of recycling hydrogen recovered from the removed vapor component into a hydrogen gas stream being introduced into the process.

7. A hydrorefining method according to claim 1, wherein the holding member is a valve tray.

8. A hydrorefining unit for hydrorefining hydrocarbon feed oil including sulfur-containing compounds, comprising:

a first catalyst layer and a second catalyst layer;

a holding member positioned between the first catalyst layer and second catalyst layer for temporarily holding a liquid component that flows out from the first catalyst layer, wherein said holding member is a valve tray;

a hydrogen feed source;

a hydrogen introduction part, that is connected to the hydrogen feed source, for simultaneously introducing hydrogen from the hydrogen feed source to the liquid component held in the holding member and the second catalyst layer, wherein the hydrogen introduced from the hydrogen introduction part has a first hydrogen gas stream and a second hydrogen gas stream;

a separation space that is positioned at the bottom of the first catalyst layer for separation of vapor component and liquid component;

means for adjusting pressure of the separation space and/or a space between the holding member and the second catalyst layer; and a gas outlet through which the vapor component is discharged from the separation space.

9. A hydrorefining unit according to claim 8, wherein said means for adjusting pressure comprises a flow meter and flow adjustment valve that are operatively connected to said gas outlet.

10. A hydrorefining unit according to claim 8, further comprising means for recycling hydrogen from the discharged vapor component into the hydrogen introduction part.

11. A hydrorefining unit according to claim 8, wherein the first catalyst layer, second catalyst layer, and holding member are housed in a single reaction vessel.

12. A hydrorefining unit according to claim 8, wherein the holding member is a tray which has a discharge hole for liquid component and in which liquid component accumulates.

13. A hydrorefining unit according to claim 8, wherein impurities are stripped from the liquid component held in the holding member by the first hydrogen gas stream.

14. A hydrorefining unit according to claim 13, wherein the impurities are hydrogen sulfide and/or ammonia.

15. A hydrorefining unit for hydrorefining hydrocarbon feed oil including sulfur-containing compounds, comprising:

a first catalyst layer and a second catalyst layer;

a holding member positioned between the first catalyst layer and second catalyst layer for temporarily holding a liquid component that flows out from the first catalyst layer, wherein said holding member is a valve tray;

a hydrogen feed source;

a hydrogen introduction part, that is connected to the hydrogen feed source, for simultaneously introducing hydrogen from the hydrogen feed source to the liquid component held in the holding member and the second catalyst layer;

a separation space that is positioned at the bottom of the first catalyst layer for separation of vapor component and liquid component, wherein the separation space and/or a space between the holding member and the second catalyst layer can have its pressure adjusted; and a gas outlet through which the vapor component is discharged from the separation space.

16. A hydrorefining unit according to claim 15, comprising a flow meter and flow adjustment valve operatively connected to said gas outlet for the adjustment of pressure in the separation space and/or the space between the holding member and the second catalyst layer.

17. A hydrorefining unit according to claim 15, further comprising means for recycling hydrogen from the discharged vapor component into the hydrogen introduction part.

* * * * *